US005533490A

United States Patent [19]

Pascall

[11] Patent Number: 5,533,490

[45] Date of Patent: Jul. 9, 1996

[54] FUEL CONDITIONING DEVICE

[76] Inventor: Brian Pascall, 9, Woodlands Way, Southampton SO1 2TJ, England

[21] Appl. No.: 64,162

[22] PCT Filed: Sep. 16, 1991

[86] PCT No.: PCT/GB91/01584

§ 371 Date: May 12, 1993

§ 102(e) Date: May 12, 1993

[87] PCT Pub. No.: WO92/05359

PCT Pub. Date: Apr. 2, 1992

[30] Foreign Application Priority Data

Sep. 15, 1990 [GB] United Kingdom ..... 9020205

[51] Int. Cl.[6] ..... F02B 75/12; F02M 27/00

[52] U.S. Cl. ..... 123/538

[58] Field of Search ..... 123/536, 537, 123/538, 1 R, 1 A; 210/222, 223; 44/354; 431/2, 4

[56] References Cited

U.S. PATENT DOCUMENTS

| | | | |
|---|---|---|---|
| 4,050,426 | 9/1977 | Sanderson | 123/538 |
| 4,461,262 | 7/1984 | Chow | 123/538 |
| 4,538,582 | 9/1985 | Wakuta | 123/536 |
| 4,715,325 | 12/1987 | Walker | 123/538 |
| 5,013,450 | 5/1991 | Gomez | 123/538 |
| 5,044,347 | 9/1991 | Ullrich et al. | 123/538 |
| 5,048,499 | 9/1991 | Daywalt | 123/538 |
| 5,059,217 | 10/1991 | Arroyo et al. | 123/538 |
| 5,249,552 | 10/1993 | Brooks | 123/1 |

FOREIGN PATENT DOCUMENTS

| | | | |
|---|---|---|---|
| 0399801 | 11/1990 | European Pat. Off. . | |
| 1290925 | 3/1962 | France . | |
| 0153850 | 12/1980 | Japan . | |
| 1079698 | 8/1967 | United Kingdom | C22C 11/00 |

OTHER PUBLICATIONS

Pearce, J. A. The Chemistry Of Tin–Alloy Fuel Additives May 4, 1990.

*Primary Examiner*—E. Rollins Cross
*Assistant Examiner*—M. Macy
*Attorney, Agent, or Firm*—Robert W. J. Usher

[57] ABSTRACT

A fuel conditioning device for installation in a fuel supply line of an internal combustion engine comprises a housing having a cylindrical ferromagnetic wall defining a fuel flow path and, in the flow path, a tin alloy body and a magnet adjacent and downstream thereof. The tin body has fins extending perpendicularly from a central diametrical spine and the magnet is diametrically disposed along the housing and has poles on opposite sides which face the housing wall so that substantially all fuel flows between the faces of the magnet and the wall. Apertured distributor plates can be positioned across the flow path to induce turbulence in the fuel thereby improving washing over the alloy.

16 Claims, 2 Drawing Sheets

FUEL CONDITIONING DEVICE

This invention relates to a fuel conditioning device, that is to say, a unit which can be installed in the fuel supply line of an internal combustion engine so as to condition the fuel before it reaches the combustion chambers so that the engine performs more efficiently.

Such a unit has application wherever engines are employed, but its major application is in connection with motor vehicles. It is known to employ lead compounds in motor fuel to improve octane ratings. However, concern for the environment has resulted in unleaded petrol being used with increasing frequency, but unleaded petrol either does not have the same octane rating, or is more expensive to produce than leaded petrol.

It has been known for some time that tin can also improve octane rating, and improve the cetane rating in diesel fuel. Tin may also deposit on moving parts inside a combustion engine, and so reduce friction and engine noise.

It has independently been suggested that conventional fuel subjected to a magnetic field shortly before entering the combustion chamber also appears to burn more efficiently. The precise reasons for this are not clear, but it may be that the fuel molecules are in some way aligned with respect to each other by the magnetic field and therefore are more easily combustible. Another theory suggests that the fuel molecules pick up a charge in the presence of the magnetic field which thus makes it easier for oxygen to combine with those charged molecules during the combustion process.

In EP-A-0 399 801 it has been suggested to combine these effects by washing fuel over tin alloy fuel additive pellets while the pellets are within the magnetic field of a magnet. This document describes and illustrates the use of a separated pair of relatively small ferrite magnets, facing one another, located by plastics spacers centrally within a plastics tube. The fuel flows through the tube, first past tin alloy cones lying in the magnets' field, then through a steel mesh disc and a plastics spacer, and then around and between the two magnets, before passing to the engine.

It is an object of the present invention to provide an improved fuel conditioning unit which combines the effects of a tin alloy additive and magnetic treatment in a novel, efficient and simple manner.

In accordance with one aspect of the present invention a fuel conditioning device comprises a housing defining a fuel flow path between a fuel inlet and a fuel outlet to the housing, and in the fuel flow path a tin alloy body and a magnet downstream thereof; wherein the fuel flow path is so configured in the region of the magnet, and the magnet has pole faces which are so disposed in relation to the fuel flow path, that substantially all fuel therein is constrained to flow past the said pole faces of the magnet; and flow distribution means are disposed in the fuel flow path immediately upstream of the magnet and are adapted to duct fuel wholly between the said pole faces of the magnet and the housing defining the fuel flow path.

Preferably the housing defining the fuel flow path in the region of the magnet is of ferromagnetic material, and substantially all the fuel in the flow path is constrained to flow between the pole faces of the magnet and the ferromagnetic housing.

The flow distribution means may comprise a plate, especially of ferromagnetic material, across the fuel path, provided with fuel flow apertures aligned with the fuel flow path between the pole faces of the magnet and the sides of the housing.

The tin alloy body is desirably shielded, as by the flow distribution means, from the magnetic field of the magnet. This has been found to give excellent fuel efficiency.

The magnet is advantageously an anisotropic permanent ferrite magnet, located centrally in the fuel flow path. Preferably the magnet is a block in the form of a flat cuboid with the poles on each of its opposite longer flat faces, and it is arranged with those pole faces parallel to the axis of the housing, directed outwardly towards the sides of the housing.

The arrangement ensures that substantially all fuel passes through the most intense magnetic field after exposure to the tin alloy. In addition, the ferromagnetic (for example mild steel) housing and distribution means act as keeper or armature to complete the magnetic circuit between the opposite pole faces of the magnet and concentrate the field within the fuel flow path past the magnet.

In accordance with a further aspect of this invention there is provided a fuel conditioning device adapted to be disposed in the fuel supply line of an internal combustion engine, which device comprises a substantially cylindrical housing in which is disposed a tin alloy body which has a constant cross section just fitting within the housing, said cross section comprising a central backbone extending diametrically across the housing and fins substantially at right angles thereto, a magnet, and closures at each end of the housing having means for connection with the engine fuel supply line, the device being arranged, in use, to permit fuel to pass through the housing and firstly over the fins and backbone of the alloy body and secondly over the magnet, before entering said engine.

The tin alloy body in this form has been found to be especially successful. Large surface area and good fuel flow characteristics past the backbone and fins are particularly well matched to the preferred flow distribution means and magnet.

Preferably, the backbone has three fins, that is to say, a central diametrical fin corresponding to, and perpendicular to, the backbone, and two shorter lateral fins one each between the ends of the backbone and the central fin, arranged so that the ends of the backbone and fins lie in a circle of diameter slightly less than the internal diameter of the housing. The tin alloy body is preferably substantially cylindrical in overall outline.

Preferably the alloy body and magnet are located axially within the housing between the end closures under pressure from a spring. This prevents the components from rattling.

Preferably an end closure comprises a cylindrical body matching the housing and a male connector for attachment of a fuel supply hose, a through bore being formed through the body and male connector. The body may be a close sliding fit in the end of the housing, and may be provided with an O-ring to seal against the inside of the housing, the body being located by a flange on the body cooperating with a shoulder in the housing, and being secured in position by spinning over of the end of the housing in a lathe.

Preferably the end closures are identical. Moreover, the through bore may be chamfered at its opening to the interior of the housing to facilitate fuel flow around the alloy body.

Preferably said alloy has at least the following components, that is to say, by weight:

a) 50–90% tin;

b) 6–30% antimony;

c) 1–10% lead; and, d) 3–20% mercury.

Preferably the approximate proportions of each component are 70% tin, 18% antimony, 3% lead and 9% mercury.

A plurality of tin alloy bodies may be separated by baffle plates. They may be longitudinally aligned but rotationally staggered with respect to each other.

The invention is further described hereinafter, by way of example only, with reference to the accompanying drawings, in which.

Figure 1:
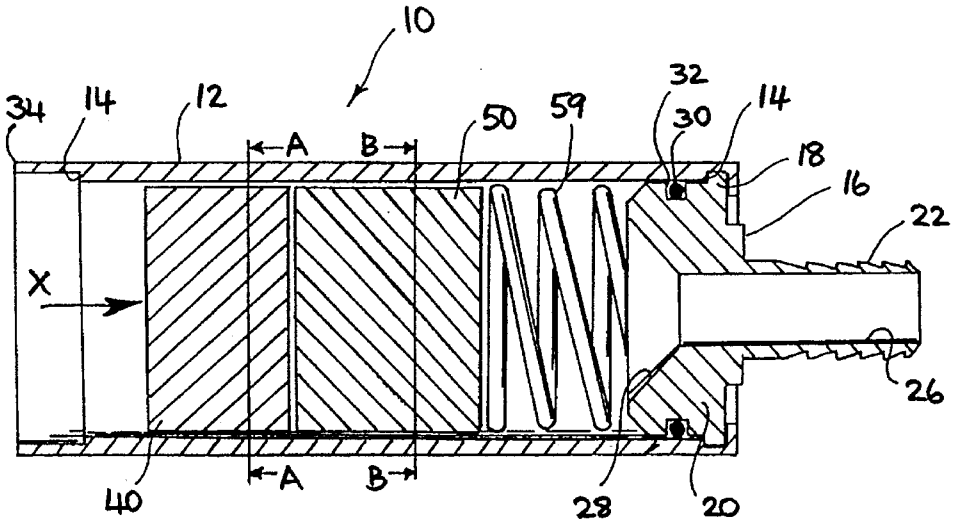
FIG. 1 is a longitudinal section through a first embodiment of a fuel conditioning device according to the present invention.
Figure 3:
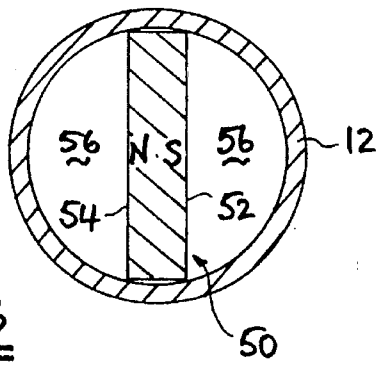
FIG. 3 is a section taken along the line B—B in FIG. 1.
Figure 2:
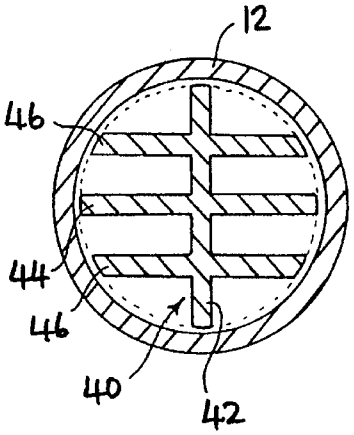
FIG. 2 is a section taken along the line A—A in FIG. 1.

In the first embodiment of the invention shown in FIGS. 1 to 3, a fuel conditioning unit 10 has a housing 12 of mild steel, a ferromagnetic material, externally plated with nickel and chromium to protect against corrosion. The housing forms a fuel flow path. It is of a circular section and has a shoulder 14 at each end. Each shoulder 14 is adapted to receive and locate an end closure 16, only one of which is shown. The end closure 16 has a body 20 and a male connector 22, which forms a fuel outlet at which a fuel hose can be connected to the unit 10. A flange 18 on the body 20 mounts the end closure in the housing 12. The connector 22 and body 20 have a through bore 26, which is chamfered at its mouth 28. The end closure 16 is sealed to the housing 12 by an O-ring 30 retained within a circumferential groove 32 in the body 20 of the end closure 16. The end closure is secured in the housing by spinning over of the ends 34 of the housing 12 in a lathe.

Inside the housing are at least three components. The first is an alloy body 40, shown in transverse section in FIG. 2. In section, the body 40 has a backbone 42 and three fins at right angles to the backbone, that is to say, a central fin 44 which matches the backbone 42, and side fins 46 disposed between the central fin 44 and the ends of the backbone 42. The backbone and fins are so dimensioned that their ends lie on a circle whose diameter is slightly less than the internal diameter of the housing 12, so that the body 40 is a close sliding fit in the housing 12. In side view the body is substantially rectangular.

The body is constructed from an alloy consisting essentially of 70% tin, 18% antimony, 9% mercury and 3% lead.

The second component is a magnet 50 in the form of an anisotropic ferrite block, shown in transverse section in FIG. 3. The magnet is a substantially flat cuboid which extends diametrically across the housing 12. The magnetic poles N-S are arranged on the magnet's longer flat surfaces 52 and 54, parallel to the axis of the housing. This arrangement ensures that the magnetic lines of force of the magnet are concentrated in the spaces 56 on either side of the magnet through which fuel being supplied to the engine passes.

The steel sides of the housing 12, which the magnetic poles face across the fuel flow path in the spaces 56, are continuous around the magnet and close the magnetic circuit. Owing to the anisotropic nature of the magnet, substantially no magnetic field extends axially along the housing from the magnet, but although not shown in FIG. 1, a ferromagnetic flow distribution plate, of the kind described below in relation to FIGS. 4 to 7, may be placed between the magnet 50 and the alloy body 40.

Finally, the last component is a spring 59 which keeps the components 40 and 50 in position after it is compressed when the second end closure 16 (which is not shown) has been inserted into the open end of the housing and secured in place.

The shape of the body 40 is designed to offer maximum surface area to fuel flowing over it, in the direction of the arrow X in the drawings, on its way to the engine. Moreover, the chamfering of the mouth 28 is particularly helpful in ensuring that fuel is evenly distributed over the body, and consequently that the fuel picks up an even amount of the components of the alloy which aid fuel combustion.

The second embodiment of the invention shown in FIGS. 4 to 7 differs in that it has a longer housing, which contains three alloy bodies separated by baffle plates, and a slightly larger magnet supported by a steel fuel distributor plate between the alloy bodies and the magnet. The end closures with the fuel inlet and outlet are substantially unchanged.

Figure 4:
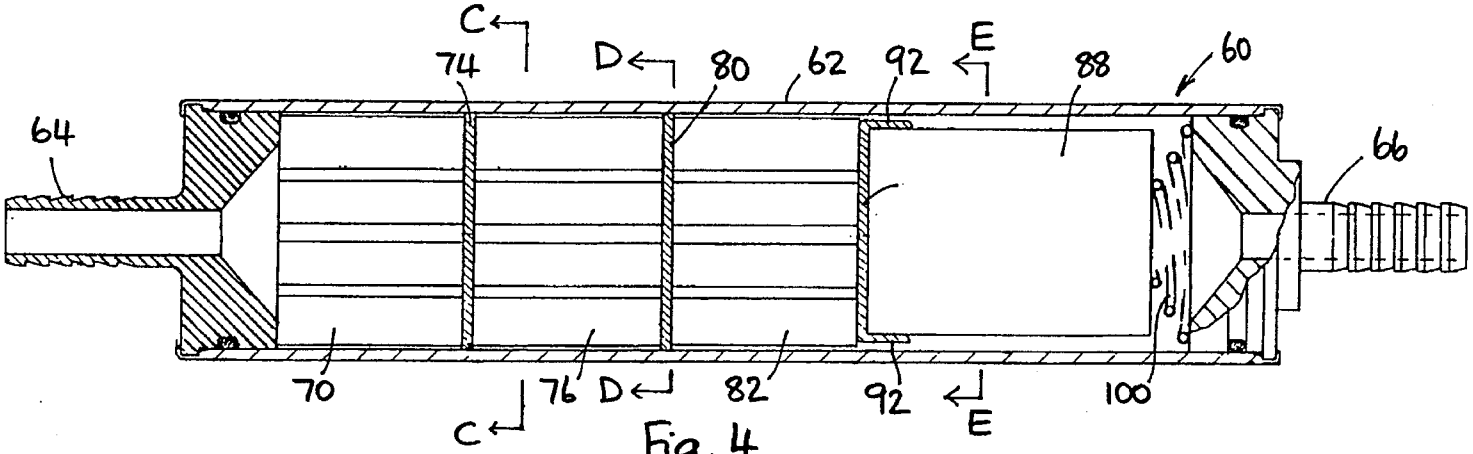
FIG. 4 is a longitudinal section, with a partial cutaway at one end, through a second embodiment of a fuel conditioning device according to the invention.

Referring now to FIG. 4, the fuel conditioning device 60 comprises a cylindrical, externally plated, steel housing 62, which defines a fuel flow path between a fuel inlet in end closure 64 and a fuel outlet in end closure 66. The device is connected into a fuel line leading to an internal combustion engine.

Figure 6:
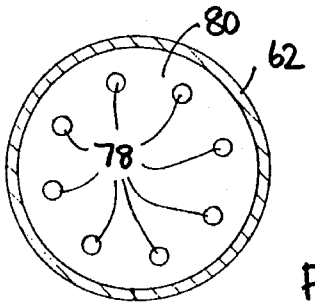
FIG. 6 is a section taken along the line D—D in FIG. 4.
Figure 5:
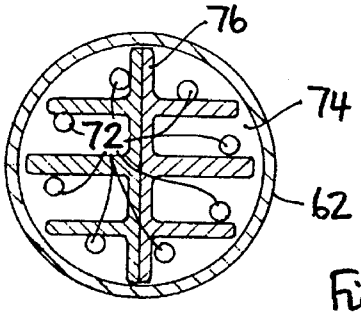
FIG. 5 is a section taken along the line C—C in FIG. 4.

Referring also to FIGS. 5 and 6, fuel passing through the device washes over a first tin alloy body 70, passes through apertures 72 in a first steel disc baffle plate 74, washes over a second tin alloy body 76, passes through apertures 78 in a second steel disc baffle plate 80, and then washes over a third tin alloy body 82. The alloy bodies are effectively identical to the alloy body 40 shown in FIGS. 1 and 2, in shape and composition, except that they are each cast in two equal halves (FIG. 5), for improved manufacture, the two halves being placed back to back in the housing 62 to make up each whole body.

The steel baffle plates 74 and 80 serve to increase the residence time of the fuel in contact with the tin alloy and to induce turbulence in the flow to improve washing over the alloy. For further improvement, the alignment of the alloy bodies may be rotationally staggered.

Figure 7:
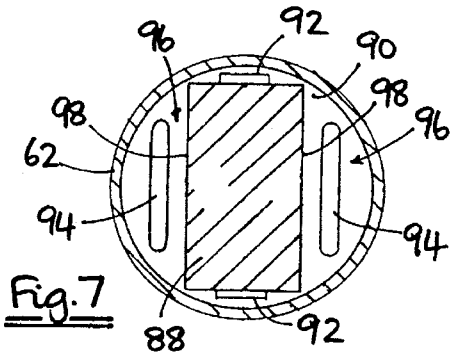
FIG. 7 is a section taken along the line E—E in FIG. 4.

As shown in FIGS. 4 and 7, the fuel then passes through apertures 94 in disc-shaped mild steel distributor plate 90 and into a fuel flow path that lies substantially entirely in spaces 96 on either side of a magnet 88. The apertures 94 duct the fuel wholly into these spaces 96.

The distributor plate 90 is provided with lugs 92 which hold the magnet 88 centrally in the housing, and also prevent relative rotation between the plate and the magnet. This preserves the proper alignment of the apertures 94 with the spaces 96.

The magnet 88 is another anisotropic permanent ferrite magnet block in the form of a flat cuboid with the north and south poles on the opposite longer flat faces 98 parallel to the axis of the housing and directed outwardly towards the sides of the housing across the spaces 96 in which the fuel flows. As in the first illustrated embodiment of the invention, the .steel wall of the housing completes the magnetic circuit, and all the fuel passes across a pole of the magnet. The small quantity of fuel that lies between the non-polar side faces of the magnet and the adjacent housing wall is in a stagnant region of the flow path and can be discounted as it will form an insignificant proportion of the fuel passing through the device in use.

The ferromagnetic steel disc 90 in combination with the highly directional magnetic field and the steel housing around the magnet ensure that the tin alloy bodies are effectively shielded from the field of the magnet, while the device retains a highly beneficial performance.

Between the magnet 88 and the fuel outlet end closure 66, a compression spring 100 keeps the whole assembly within the housing under axial pressure, to stop rattles and movement between the components.

An equivalent distribution plate to plate 90, adapted to fit housing 12 and magnet 50, may with advantage be used in the first embodiment of the invention illustrated in FIGS. 1 to 3.

The apertures in the plate and the arrangement of the magnet ensure that the fuel passes through the most intense regions of the magnetic field. Further, we have found that it is not necessary for the tin alloy to lie in the magnetic field for the benefit of the tin alloy to be effectively combined with the action of the magnetic field. The fuel may on the contrary first be treated with the alloy body, using an appropriate alloy body shape which owes no consideration to any magnetic field, and may then be conditioned in the magnetic field in a fuel flow path which is concerned only with efficient exposure to the field.

What is claimed is:

1. A fuel conditioning device comprising a housing having a fuel inlet and a fuel outlet, said housing defining a fuel flow path between said fuel inlet and said fuel outlet, and in the fuel flow path a tin alloy body and a magnet adjacent and downstream thereof; wherein the fuel flow path is so configured in the region of the magnet, and the magnet has pole faces which are so disposed in relation to the fuel flow path, that substantially all fuel therein is constrained to flow past the pole faces of the magnet between the pole faces of the magnet and the housing defining the fuel flow path.

2. A device according to claim 1 wherein the housing defining the fuel flow path in the region of the magnet is of ferromagnetic material, and substantially all the fuel in the flow path is constrained to flow between the pole faces of the magnet and the ferromagnetic housing.

3. A device according to claim 1 wherein flow distribution means are disposed in the fuel flow path immediately upstream of the magnet and are adapted to duct fuel wholly between the pole faces of the magnet and the housing defining the fuel flow path.

4. A device according to claim 3 wherein the flow distribution means comprise a plate across the fuel path, provided with fuel flow apertures aligned with the fuel flow path between the pole faces of the magnet and the sides of the housing.

5. A device according to claim 1 wherein the magnet is an anisotropic permanent ferrite magnet located centrally in the fuel flow path.

6. A device according to claim 5 wherein the magnet is a block in the form of a flat cuboid with its magnetic poles on each of two opposite longer flat faces, and it is arranged to extend across the fuel flow path, with those pole faces parallel to the axis of the housing and directed outwardly towards the sides of the housing.

7. A fuel conditioning device adapted to be disposed in the fuel supply line of an internal combustion engine, which device comprises a substantially cylindrical housing in which is disposed a tin alloy body which has a constant cross section just fitting within the housing, said constant cross section comprising a central backbone extending diametrically across the housing and having fins substantially at right angles thereto including a central diametrical fin corresponding to and perpendicular to the backbone and two shorter lateral fins one each between the ends of the backbone and the central fin, arranged so that the ends of the backbone and fins lie in a circle of diameter slightly less than the internal diameter of the housing, a magnet, and closures at each end of the housing having means for connection with the engine fuel supply line, the device being arranged, in use, to permit fuel to pass through the housing and firstly over the fins and backbone of the alloy body and secondly over the magnet, before entering said engine.

8. A device according to claim 7 wherein the alloy body and magnet are located axially within the housing under pressure from a spring.

9. A device according to claim 7 wherein the alloy contains, by weight, at least 50–90% tin, 6–30% antimony, 1–10% lead, and 3–20% mercury.

10. A device according to claim 9 wherein the alloy contains approximately 70% tin, 18% antimony, 3% lead and 9% mercury.

11. A device according to claim 7 wherein a plurality of said tin alloy bodies are separated by baffle plates.

12. A device according to claim 7 wherein a plurality of said tin alloy bodies are longitudinally aligned but rotationally staggered with respect to each other.

13. A fuel conditioning device adapted to be disposed in the fuel supply line of an internal combustion engine, which device comprises a substantially cylindrical housing in which are disposed a tin alloy body and an adjacent magnet, and end closures at each end of the housing having means for connection with the engine fuel supply line, the device being arranged, in use, to permit fuel to pass through the housing in a flow path firstly over the alloy body and secondly over the magnet, before entering said engine, wherein said alloy body has a constant cross section just fitting within the housing, said cross section comprising a central backbone extending diametrically across the housing and fins substantially at right angles thereto, and said backbone and fins are aligned with the direction of fuel flow through the housing, and the magnet bisects the fuel flow path by taking the form of a flat cuboid with its magnetic poles on each of its opposite longer flat faces and being arranged on a diameter of the housing with those pole faces parallel to the axis of the housing, directed outwardly towards the sides of the housing, whereby substantially all fuel in the fuel flow path is constrained to flow past the pole faces of the magnet.

14. A device according to claim 13 wherein the housing defining the fuel flow path in the region of the magnet is of ferromagnetic material, and substantially all the fuel in the flow path is constrained to flow between the pole faces of the magnet and the ferromagnetic housing.

15. A device according to claim 13 wherein the backbone has a central diametrical fin corresponding to, and perpendicular to, the backbone, and two shorter lateral fins one each between the ends of the backbone and the central fin, arranged so that the ends of the backbone and fins lie in a circle of diameter slightly less than the internal diameter of the housing.

16. A device according to claim 13 wherein said end closure comprises a cylindrical body received in an end of said housing provided with a male connector for the attachment of a fuel supply hose, and a through bore formed through said body and male connector, said through bore being chamfered at its opening to the interior of the housing.

* * * * *